US007138163B2

(12) United States Patent
Ieshige et al.

(10) Patent No.: US 7,138,163 B2
(45) **Date of Patent: *Nov. 21, 2006**

(54) THERMAL TRANSFER SHEET

(75) Inventors: Munenori Ieshige, Tokyo-To (JP); Taro Suzuki, Tokyo-To (JP)

(73) Assignee: Dai Nippon Printing Co. Ltd, Tokyo (JP)

( * ) Notice: Subject to any disclaimer, the term of this patent is extended or adjusted under 35 U.S.C. 154(b) by 286 days.

This patent is subject to a terminal disclaimer.

(21) Appl. No.: 10/803,809

(22) Filed: Mar. 18, 2004

(65) Prior Publication Data

US 2004/0219313 A1 Nov. 4, 2004

(30) Foreign Application Priority Data

Mar. 20, 2003 (JP) ..... 2003-076929

(51) Int. Cl.
*B41M 5/40* (2006.01)

(52) U.S. Cl. ..... 428/32.64; 428/32.68

(58) Field of Classification Search ... 428/32.39–32.87
See application file for complete search history.

(56) References Cited

U.S. PATENT DOCUMENTS 6,710,016 B1 * 3/2004 Suzuki et al. ..... 503/227

* cited by examiner

*Primary Examiner*—Bruce H. Hess
(74) *Attorney, Agent, or Firm*—Harness, Dickey & Pierce, P.L.C.

(57) ABSTRACT

There is provided a thermal transfer sheet which can surely prevent printing-derived cockling, fusing to a thermal head or the like caused by thermal head-derived thermal damage to a primer layer provided between a substrate sheet and a heat-resistant slip layer and, at the same time, can meet a demand for a reduction in thickness of the thermal transfer sheet and has a high level of suitability for high-speed printing. The thermal transfer sheet comprises: a substrate sheet; a colorant layer provided on one side of the substrate sheet; and a heat-resistant slip layer provided on the other side of the substrate sheet through a primer layer. The primer layer comprises a binder resin satisfying a G'a/G'b ratio value of not more than 100 wherein G'a represents the storage modulus of the binder resin at 80° C., Pa; and G'b represents the storage modulus of the binder resin at 140° C., Pa. For the binder resin satisfying the above relation expression of the modulus of elasticity, in the case of printing of an image in which a white image (a white part) and a black image (a black part) are present together, milder heat conditions are applied at the time of printing of the white part. In this case, the viscoelasticity of the primer component is high, and the storage modulus corresponds to G'a at 80° C. On the other hand, at the time of printing of the black part, since heat is applied, the viscoelasticity of the primer component is low and the storage modulus corresponds to G'b at 140° C.

5 Claims, 1 Drawing Sheet

THERMAL TRANSFER SHEET

BACKGROUND OF THE INVENTION

1. Field of the Invention

The present invention relates to a thermal transfer sheet comprising a substrate sheet, a colorant layer provided on one side of the substrate sheet, and a heat-resistant slip layer provided on the other side of the substrate sheet through a primer layer. More particularly, the present invention relates to a thermal transfer sheet which can surely prevent printing-derived cockling, fusing to a thermal head or the like caused by thermal head-derived thermal damage to a primer layer provided between a substrate sheet and a heat-resistant slip layer and, at the same time, can meet a demand for a reduction in thickness of the thermal transfer sheet and has a high level of suitability for high-speed printing.

2. Background Art

Thermal dye transfer sheets and heat-fusion thermal transfer sheets are known as thermal transfer sheets. In the thermal dye transfer sheets, a dye layer comprising a sublimable dye and a binder resin is provided on one side of a substrate sheet, for example, a plastic film such as a polyester film. On the other hand, in the heat-fusion thermal transfer sheets, the construction is the same as that of the thermal dye transfer sheets except that an ink layer formed of a colorant-containing heat-fusion composition is provided instead of the dye layer. In use, these thermal transfer sheets are heated imagewise from the backside thereof by means of a thermal head or the like to transfer the dye in the dye layer or the ink layer to an object and consequently to form an image on the object.

In recent years, there is a tendency toward an increase in a printing speed in thermal transfer recording. The conventional thermal transfer sheets, however, cannot cope with this tendency. Specifically, when printing is carried out using the conventional thermal transfer sheet by conventional heat energy, satisfactory sensitivity in transfer cannot be provided. Further, for prints having a thermally transferred image, higher image density and higher image sharpness have become required. The sensitivity in transfer should be improved for meeting this demand. Methods which have been proposed for improving the sensitivity in transfer include one in which the thickness of the substrate sheet is reduced and printing is carried out by conventional heat energy and one in which heat energy at the time of printing is increased to provide desired sensitivity in transfer. In these methods, however, thermal damage to the thermal transfer sheet is so large that problems such as printing-derived cockling, fusing of the thermal transfer sheet to a thermal head, and breaking of a ribbon disadvantageously occur.

Further, there is an ever-increasing need for a reduction in size of printers. However, the difficulty of realizing power saving involved in the conventional thermal transfer sheets has hitherto been an obstacle to the reduction in size of printers. In order to realize good sensitivity in transfer with lowered power consumption, a reduction in thickness of the substrate sheet has been attempted. This, however, has led to the same problems as described above, that is, printing-derived cockling, fusing of the thermal transfer sheet to a thermal head, breaking of a ribbon or other problems.

On the other hand, the incorporation of a resin having, at 120° C., an elasticity G' of not less than $10^3$ Pa and a viscosity G" of not less than $10^4$ Pa as a primer component in a primer layer for a heat-resistant slip layer has been proposed in Japanese Patent Laid-Open No. 1653/2001. This method, however, suffers from the following problem. Specifically, in the case of printing of an image in which white and black images are present together, the primer component behaves as follows. In the printing of a white part, heating conditions for printing are mild, and the viscosity and the elasticity are high, while, in the printing of a black part, heating is carried out and, thus, the viscoelasticity of the primer component is lowered. Due to this behavior, printing-derived cockling disadvantageously occurs at the boundary part between the white part and the black part. Therefore, this method cannot cope with a reduction in thickness of the substrate and an increase in heat energy without difficulties.

SUMMARY OF THE INVENTION

The present inventors have found that, when a binder resin constituting a primer layer satisfies a specific requirement, a thermal transfer sheet can be provided which can surely prevent printing-derived cockling, fusing to a thermal head or the like caused by thermal head-derived thermal damage to a primer layer provided between a substrate sheet and a heat-resistant slip layer and, at the same time, can meet a demand for a reduction in thickness of the thermal transfer sheet and has a high level of suitability for high-speed printing.

According to one aspect of the present invention, there is provided a thermal transfer sheet comprising: a substrate sheet; a colorant layer provided on one side of the substrate sheet; and a heat-resistant slip layer provided on the other side of the substrate sheet through a primer layer, said primer layer comprising a binder resin satisfying a G'a/G'b ratio value of not more than 100 wherein G'a represents the storage modulus of the binder resin at 80° C., Pa; and G'b represents the storage modulus of the binder resin at 140° C., Pa.

Preferably, both the storage modulus G'b (Pa) of the binder resin and the loss modulus G"b (Pa) of the binder resin each as measured at 140° C. are not less than $10^3$ Pa.

Preferably, the binder resin has a tan δ value of not more than 3 at 140° C.

Preferably, the binder resin has a glass transition temperature Tg of 60° C. or above.

Preferably, the primer layer contains an antistatic agent.

As described above, the present invention provides a thermal transfer sheet comprising: a substrate sheet; a colorant layer provided on one side of the substrate sheet; and a heat-resistant slip layer provided on the other side of the substrate sheet through a primer layer. The primer layer comprises a binder resin satisfying a G'a/G'b ratio value of not more than 100 wherein G'a represents the storage modulus of the binder resin at 80° C., Pa; and G'b represents the storage modulus of the binder resin at 140° C., Pa. Preferably, both the storage modulus G'b (Pa) of the binder resin and the loss modulus G"b (Pa) of the binder resin each as measured at 140° C. are not less than $10^3$ Pa, and the binder resin has a tan δ value of not more than 3 at 140° C.

Regarding the binder resin satisfying the above relation expression of the modulus of elasticity, in the case of printing of an image in which a white image (a white part) and a black image (a black part) are present together, milder heat conditions are applied at the time of printing of the white part. In this case, the viscoelasticity of the primer component is high, and the storage modulus corresponds to G'a at 80° C. On the other hand, at the time of printing of the black part, since heat is applied, the viscoelasticity of the primer component is low and the storage modulus corresponds to G'b at 140° C. When the requirement G'a/G'b ratio of not more than 100 is satisfied, there is no fear of causing printing-derived cockling or fusing to a thermal head even upon printing of an image, in which a white part and a black part are present together, and, at the same time, a reduction in thickness of the substrate sheet and a high level of suitability for high speed printing can be realized.

DESCRIPTION OF REFERENCE CHARACTERS IN THE DRAWINGS

1: substrate sheet, 2: primer layer, 3: heat-resistant slip layer, 4: colorant layer, and 5: primer layer.

DETAILED DESCRIPTION OF THE INVENTION

Next, embodiments of the present invention will be described in more detail.

Figure 1:
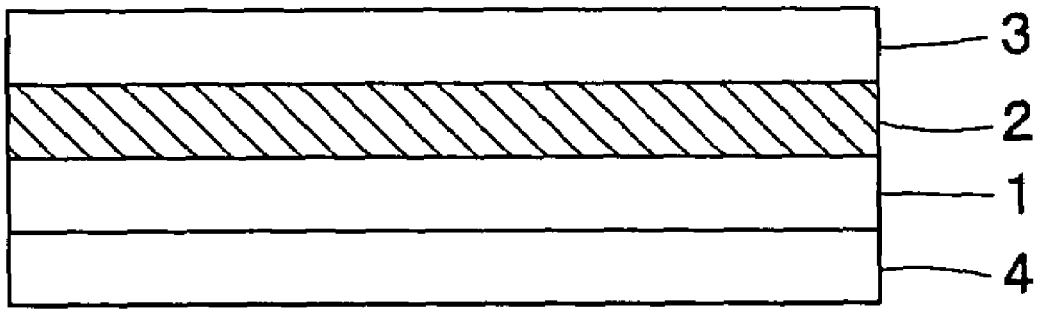
FIG. 1 is a schematic cross-sectional view showing one embodiment of the thermal transfer sheet according to the present invention.

FIG. 1 is a schematic cross-sectional view showing one embodiment of the thermal transfer sheet according to the present invention. In this thermal transfer sheet, a heat-resistant slip layer 3 for improving the slipperiness of a thermal head and for preventing sticking is provided on one side of a substrate sheet 1 through a primer layer 2. A colorant layer 4 is provided on the other side of the substrate sheet 1.

Figure 2:
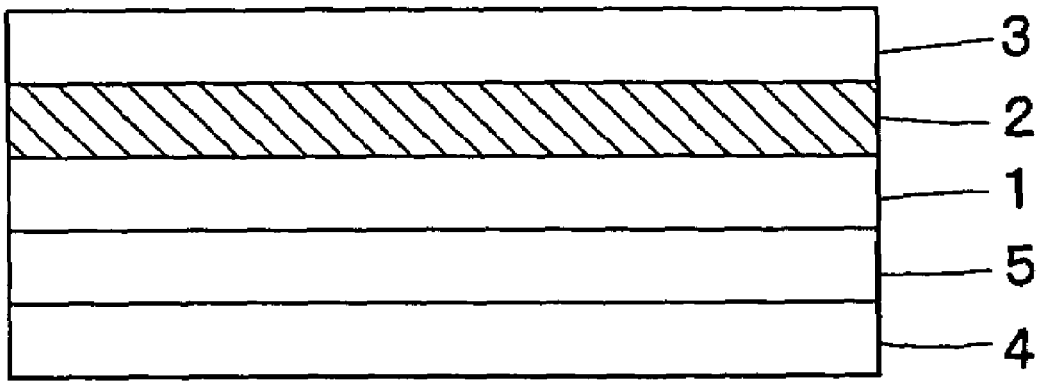
FIG. 2 is a schematic cross-sectional view showing another embodiment of the thermal transfer sheet according to the present invention.

FIG. 2 is a schematic cross-sectional view showing another embodiment of the thermal transfer sheet according to the present invention. In this thermal transfer sheet, a heat-resistant slip layer 3 for improving the slipperiness of a thermal head and for preventing sticking is provided on one side of a substrate sheet 1 through a primer layer 2. A primer layer 5 and a colorant layer 4 are provided in that order on the other side of the substrate sheet 1.

Individual layers constituting the thermal transfer sheet according to the present invention will be described in detail.

Substrate Sheet

The substrate sheet 1 used in the thermal transfer sheet according to the present invention may be any conventional substrate sheet so far as the substrate sheet has certain level of heat resistance and strength. Examples of substrate sheets usable herein include 0.5 to 50 μm-thick, preferably about 1 to 10 μm-thick, films of polyethylene terephthalate, 1,4-polycyclohexylene dimethylene terephthalate, polyethylene naphthalate, polyphenylene sulfide, polystyrene, polypropylene, polysulfone, aramid, polycarbonate, polyvinyl alcohol, cellulose derivatives, such as cellophane and cellulose acetate, polyethylene, polyvinyl chloride, nylon, polyimide, and ionomer.

The above substrate sheet on its colorant layer forming side is often subjected to adhesion treatment. When a colorant layer is coated onto a plastic film as the substrate sheet, for example, the wettability of the plastic film by the coating liquid and the adhesion of the plastic film to the coating are often unsatisfactory. To overcome this drawback, adhesion treatment may be carried out. Conventional resin surface modification techniques, such as corona discharge treatment, flame treatment, ozone treatment, ultraviolet treatment, radiation treatment, roughening treatment, chemical treatment, plasma treatment, low-temperature plasma treatment, primer treatment, and grafting treatment, as such may be applied to the adhesion treatment. These treatment methods may also be used in a combination of two or more. The primer treatment may be carried out, for example, by coating a primer liquid onto an unstretched film or a film during stretching at the time of the formation of a plastic film by melt extrusion and then stretching the film.

Further, for the adhesion treatment of the substrate sheet, a primer layer 5 may be formed by coating between the substrate sheet and the colorant layer. The primer layer may be formed of a resin. Resins usable for primer layer formation include: polyester resins; polyacrylic ester resins; polyvinyl acetate resins; polyurethane resins; styrene acrylate resins; polyacrylamide resins; polyamide resins; polyether resins; polystyrene resins; polyethylene resins; polypropylene resins; vinyl resins such as polyvinyl chloride resins, polyvinyl alcohol resins, and polyvinylpyrrolidone resins; and polyvinyl acetal resins such as polyvinyl acetoacetal resins and polyvinyl butyral resins.

Primer Layer

The primer layer 2 interposed between the substrate sheet and the heat-resistant slip layer in the thermal transfer sheet according to the present invention is characterized in that the G'a/G'b ratio value is not more than 100 wherein G'a represents the storage modulus of the binder resin constituting the primer layer at 80° C., Pa; and G'b represents the storage modulus of the binder resin at 140° C., Pa. The storage modulus G'a at 80° C. corresponds to a storage modulus under assumed heating conditions of a white part (a non-printing state) in printing an image in which a white image and a black image are present together. On the other hand, the storage modulus G'b at 140° C. corresponds to a storage modulus under assumed heating conditions in printing the black part. When the G'a/G'b ratio is brought to not more than 100, even in printing an image in which a white image and a black image are present together, the difference in viscoelasticity of the binder resin constituting the primer layer between during printing of a white part, i.e., a non-printing part, and during printing of a black part, i.e., a printing part, can be reduced. Therefore, any printing-derived cockling does not occur even in the case of printing of an image in which a white image and a black image are present together.

On the other hand, the G'a/G'b ratio, wherein G'a represents the storage modulus of the binder resin constituting the primer layer at 80° C. and G'b represents the storage modulus of the binder resin at 140° C., is more than 100, in printing an image in which a white image and a black image are present together, the difference in viscoelasticity of the binder resin constituting the primer layer between during printing of a white part and during printing of a black part is so large that printing-derived cockling disadvantageously occurs.

The viscoelasticity is measured with ARES manufactured by Rheometrix Corp. as a measuring instrument. In the measurement, the temperature of the primer composition is raised from 30° C. to 200° C. under conditions of 10 mmϕ parallel plate, strain 0.1%, amplitude 1 Hz, temperature rise rate 2° C./min.

In general, the storage modulus G' is an elastic component and occurs upon the occurrence of coil vibration and the formation of agglomerate structure or the like in the polymer. On the other hand, the loss modulus G" is a viscous component and is equivalent to static shear stress. Tan δ is determined by G"/G' and is a measure of the level of energy absorbed upon the deformation of the material, and polymer state such as glass transition temperature of the material, the state of entanglement of side chain, and orientation can be learnt from tan δ.

Specific examples of binder resins constituting the primer layer include polyester resins, polyacrylic ester resins, polyurethane resins, styrene acrylate resins, cellulosic resins such as ethylcellulose, hydroxyethylcellulose, ethylhydroxycellulose, hydroxypropylcellulose, methylcellulose, cellulose acetate, and cellulose butyrate, polyvinyl acetal resins such as polyvinylacetoacetal and polyvinyl butyral, polyvinylpyrrolidone, and polyvinyl alcohol resins. Among them, those of grade (such as molecular weight and structure) satisfying the above modulus of elasticity requirement are selected.

The binder resin preferably has a glass transition temperature Tg of 60° C. or above. The binder resin having a glass transition temperature Tg of 60° C. or above enhances the heat resistance during heating at the time of printing with a thermal head, is effective for preventing cockling at the time of printing, and can enhance storage stability of an ink ribbon at a high temperature.

An antistatic agent may be added to the primer layer, and examples thereof include electrically conductive materials having a π electron conjugated structure, fatty esters, sulfuric esters, phosphoric esters, amides, quaternary ammonium salts, betaines, amino acids, acrylic resins, and ethylene oxide adducts.

In particular, among the above antistatic agents, electrically conductive materials having a π electron conjugated structure such as sulfonated polyaniline and polythiophene are preferred. The reason for this is as follows. The binder resin constituting the primer layer provided between the substrate sheet and the heat-resistant slip layer in the thermal transfer sheet according to the present invention preferably has a high level of compatibility with both an aqueous solvent and a organic solvent. As with the binder resin, the above antistatic agent has a high level of compatibility with both the aqueous solvent and the organic solvent and can exhibit satisfactory antistatic effect in an amount of about 0.01 to 3% by weight based on the primer layer.

Sulfonated polyanilines as the antistatic agent in the primer layer are an electrically conductive polymer material having a π electron conjugated structure, and various electrically conductive polymer materials having a π electron conjugated structure are known in the art. An example thereof is a sulfonated polyaniline represented by formula 1:

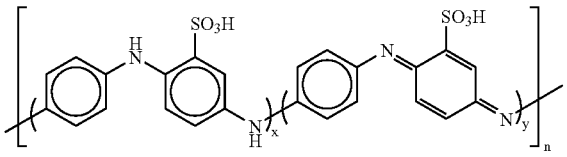

wherein x, y, and n are values for bringing the molecular weight of the sulfonated polyaniline to about 300 to 10,000.

Other electrically conductive polymer materials, such as chemically doped polyacetylene, poly-p-phenylenevinylene, poly-p-phenylene sulfide, chemically polymerized and doped polypyrrole, polythiophene, polyaniline, heat treatment products of phenolic resins, heat treated products of polyamides, and heat treatment products of perylene acid anhydride may be used as the electrically conductive polymer material having a π electron conjugated structure instead of sulfonated polyanilines. Sulfonated polyanilines and polythiophene are particularly useful as the electrically conductive polymer material having a π electron conjugated structure.

The sulfonated polyaniline is soluble in water or alkaline water-containing solvents. In this case, upon dissolution, an intramolecular salt or an alkali salt is formed. These sulfonated polyanilines are available, for example, from Nitto Chemical Industry Co., Ltd. under the tradename designation aquaSAVE-01Z and as an aqueous solution or a solution in a mixed solvent composed of water and an organic solvent.

The primer layer according to the present invention may be formed by preparing a coating liquid containing a binder resin and optionally additives such as an antistatic agent, a surfactant for improving the wettability of a substrate sheet at the time of coating, an antifoaming agent for suppressing foaming, and a crosslinking agent, for example, for improving the heat resistance and film forming property, coating the coating liquid by a conventional coating method, and drying the coating.

The coating liquid for a primer layer preferably has a composition comprising about 0.5 to 30% by weight, preferably 1 to 20% by weight, of the binder resin, about 0.01 to 10% by weight, preferably 0.01 to 5% by weight, of the antistatic agent, and about 0 to 2% by weight, preferably 0.2 to 1% by weight, of the surfactant with the balance consisting of the solvent.

The primer layer may be formed by coating the coating liquid on a substrate sheet by a conventional coating method, for example, gravure coating, roll coating, or wire bar coating, and drying the coating. The coverage on a solid basis of the primer layer is in the range of 0.01 to 1.5 g/m$^2$, preferably 0.02 to 1.0 g/m$^2$. When the coverage is below the lower limit of the above-defined coverage range, the properties of the formed primer layer are unsatisfactory. On the other hand, when the coverage is above the upper limit of the coverage of the above-defined coverage range, the effect of the primer layer is saturated. Therefore, this is disadvantageously cost-ineffective and further causes lowered density of an image formed by means of a thermal transfer printer.

Heat-Resistant Slip Layer

In the thermal transfer sheet according to the present invention, a heat-resistant slip layer 3 is provided through the primer layer on one side of a substrate to prevent adverse effects such as heat sticking of the substrate to a thermal head and cockling at the time of printing.

Any conventional resin may be used as the resin for forming the heat-resistant slip layer, and examples thereof include polyvinyl butyral resins, polyvinyl acetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, prepolymers of urethane or epoxy, nitrocellulose resins, cellulose nitrate resins, cellulose acetate propionate resins, cellulose acetate butyrate resins, cellulose acetate hydrodiene phthalate resins, cellulose acetate resins, aromatic polyamide resins, polyimide resins, polyamide-imide resins, polycarbonate resins, and chlorinated polyolefin resins.

Slipperiness-imparting agents added to or topcoated on the heat-resistant slip layer formed of the above resin include phosphoric esters, metal soaps, silicone oils, graphite powder, silicone graft polymers, fluoro graft polymers, acrylsilicone graft polymers, acrylsiloxanes, arylsiloxanes, and other silicone polymers. Preferred is a layer formed of a polyol, for example, a high-molecular polyalcohol compound, a polyisocyanate compound and a phosphoric ester compound. Further, the addition of a filler is more preferred.

The heat-resistant slip layer may be formed by dissolving or dispersing the resin, the slipperiness-imparting agent, and a filler in a suitable solvent to prepare a coating liquid for a heat-resistant slip layer, coating the coating liquid onto a substrate sheet by forming means, such as gravure printing, screen printing, or reverse roll coating using a gravure plate, and drying the coating. The coverage of the heat-resistant slip layer is preferably 0.1 to 3.0 g/m$^2$ on a solid basis.

Colorant Layer

On the surface of the substrate sheet remote from the heat-resistant slip layer is provided a thermally transferable colorant layer 4. The thermally transferable colorant layer 4 is a layer containing a sublimable dye in the case of a thermal dye transfer sheet and a layer of a heat-fusion ink colored with a pigment or the like in the case of a heat-fusion thermal transfer sheet. The thermal transfer sheet will now be described by taking a thermal dye transfer sheet as a representative example. However, it should be noted that the present invention is not limited to the thermal dye transfer sheet only. Dyes usable in the thermal dye transferable colorant layer may be any dye used in the conventional thermal transfer sheet without particular limitation. Specific examples thereof include: diarylmethane dyes; triarylmethane dyes; thiazole dyes; methine dyes such as merocyanine dyes; indoaniline dyes; azomethine dyes such as acetophenoneazomethine, pyrazoloazomethine, imidazoleazomethine, and pyridoneazomethine dyes; xanthene dyes; oxazine dyes; cyanomethylene dyes typified by dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyrrazoleazo, imidazoleazo, thiadiazoleazo, triazoleazo, and disazo dyes; spiropyran dyes; indolinospiropyran dyes; fluoran dyes; rhodaminelactam dyes; naphthoquinone dyes; anthraquinone dyes; and quinophthalone dyes.

Binder resins usable for carrying the above dye include cellulosic resins such as ethylcellulose, hydroxyethylcellulose, hydroxypropylcellulose, methylcellulose, cellulose acetate, and cellulose acetate butyrate; vinyl resins such as polyvinyl acetate, polyvinyl alcohol, polyvinyl butyral, polyvinyl acetoacetal, and polyvinylpyrrolidone, acrylic resins such as poly(meth)acrylate and poly(meth)acrylamide, polyurethane resins, polyamide resins, and polyester resins. Among them, cellulosic resins, polyurethane resins, vinyl resins, acrylic resins, and polyester resins are preferred, for example, from the viewpoints of heat resistance and dye transferability.

The dye layer may be formed on one side of the substrate sheet as follows. The above dye and binder resin are provided. If necessary, additives (such as a release agent), fillers or the like are added thereto. The mixture is dissolved in a suitable organic solvent such as toluene, methyl ethyl ketone, ethanol, isopropyl alcohol, cyclohexanone, or DMF to prepare a coating liquid. Alternatively, the mixture may be dispersed in the organic solvent, water or the like to prepare a coating liquid. The coating liquid is coated, for example, by gravure printing, screen printing, or reverse roll coating, and the coating is dried. The coverage of the dye layer is approximately 0.2 to 5.0 g/m$^2$, preferably 0.3 to 2.0 g/m$^2$ on a dry basis. The content of the sublimable dye in the dye layer is 5 to 90% by weight, preferably 10 to 70% by weight, based on the weight of the dye layer. When the formation of a monochromatic image by the thermally transferable colorant layer is desired, one dye is selected from the above dyes. On the other hand, when the formation of a full-color image is desired, suitable yellow, magenta, and cyan (and optionally black) dyes are selected.

A primer layer 5 may be provided between the colorant layer and the substrate sheet to improve the adhesion of the colorant layer to the substrate sheet. Binder resins usable for constituting the primer layer include: polyester resins; polyacrylic ester resins; polyvinyl acetate resins; polyurethane resins; styrene acrylate resins; polyacrylamide resins; polyamide resins; polyether resins; polystyrene resins; polyethylene resins; polypropylene resins; vinyl resins such as polyvinyl alcohol resins, polyvinylpyrrolidone resins, polyvinyl chloride resins, vinyl chloride-vinyl acetate copolymer resins, and ethylene-vinyl acetate copolymer resins; and polyvinyl acetal resins such as polyvinyl acetoacetal resins and polyvinyl butyral resins. The primer layer may be formed by dissolving or dispersing the binder resin optionally containing additives in water or a solvent to prepare a coating liquid and coating the coating liquid by a conventional coating method at a coverage of about 0.01 to 3.0 g/m$^2$ on a dry basis.

When the heat-fusion thermal transfer sheet is used for image formation, any object may be used with the thermal transfer sheet without particular limitation. For example, plain paper and plastic films may be used as the object. In the case of the thermal dye transfer sheet, any object may be used so far as the recording face is receptive to the above dyes. When the use of dye-nonreceptive paper, metals, glass, and synthetic resins as the object is contemplated, a dye-receptive layer may be formed on at least one side thereof. For thermal transfer using the thermal transfer sheet and the object, any conventional thermal transfer printer as such may be used without particular limitation.

EXAMPLES

The following examples further illustrate the present invention. In the following description, "parts" or "%" is by weight unless otherwise specified.

Example 1

A 3.5 μm-thick biaxially stretched polyethylene terephthalate (PET) film subjected to easy-adhesion treatment was provided as a substrate sheet. A coating liquid having the following composition for a dye layer was gravure coated onto the easy-adhesion treated face in the PET film at a coverage of 0.8 g/m$^2$ on a dry basis, and the coating was dried to form a dye layer. A coating liquid 1 having the following composition for a primer layer was then gravure coated onto the other side of the substrate sheet at a coverage of 0.2 g/m$^2$ on a dry basis, and the coating was dried to form a primer layer. A coating liquid having the following composition for a heat-resistant slip layer was gravure coated onto the primer layer at a coverage of 1.0 g/m$^2$ on a dry basis, and the coating was dried to form a heat-resistant slip layer. Thus, a thermal transfer sheet of Example 1 was prepared.

| <Coating liquid for dye layer> | |
|---|---|
| C.I. Solvent Blue 22 | 5.5 parts |
| Polyvinyl acetal resin (S-lec KS-5, manufactured by Sekisui Chemical Co., Ltd.) | 3.0 parts |
| Methyl ethyl ketone | 22.5 parts |
| Toluene | 68.2 parts |
| <Coating liquid 1 for primer layer> | |
| Polyester resin (Vylon 200, manufactured by Toyobo Co., Ltd.) | 10 parts |
| Methyl ethyl ketone | 45 parts |
| Toluene | 45 parts |
| <Coating liquid for heat-resistant slip layer> | |
| Polyvinyl butyral resin (S-lec BX-1, manufactured by Sekisui Chemical Co., Ltd.) | 13.6 parts |
| Polyisocyanate curing agent (Takenate D 218, manufactured by Takeda Chemical Industries, Ltd.) | 0.6 part |
| Phosphoric ester (Plysurf A 208 S, manufactured by Dai-Ichi Kogyo Seiyaku Co., Ltd.) | 0.8 part |
| Methyl ethyl ketone | 42.5 parts |
| Toluene | 42.5 parts |

Example 2

A thermal transfer sheet of Example 2 was prepared in the same manner as in Example 1, except that a coating liquid 2 having the following composition for a primer layer was used instead of the coating liquid 1 for a primer layer to form a primer layer.

| <Coating liquid 2 for primer layer> | |
|---|---|
| Polyester resin (Vylon 290, manufactured by Toyobo Co., Ltd.) | 10 parts |
| Methyl ethyl ketone | 45 parts |
| Toluene | 45 parts |

Example 3

A thermal transfer sheet of Example 3 was prepared in the same manner as in Example 1, except that a coating liquid 3 having the following composition for a primer layer was used instead of the coating liquid 1 for a primer layer to form a primer layer.

| <Coating liquid 3 for primer layer> | |
|---|---|
| Polyester resin (WR 905, manufactured by The Nippon Synthetic Chemical Industry Co., Ltd.) | 10 parts |
| Water | 60 parts |
| Isopropyl alcohol | 30 parts |

Example 4

A thermal transfer sheet of Example 4 was prepared in the same manner as in Example 1, except that a coating liquid 4 having the following composition for a primer layer was used instead of the coating liquid 1 for a primer layer to form a primer layer.

| <Coating liquid 4 for primer layer> | |
|---|---|
| Polyester resin (PE 723, manufactured by Futaba Fine Chemical Company) | 10 parts |
| Water | 45 parts |
| Isopropyl alcohol | 45 parts |

Example 5

A thermal transfer sheet of Example 5 was prepared in the same manner as in Example 1, except that a coating liquid 5 having the following composition for a primer layer was used instead of the coating liquid 1 for a primer layer to form a primer layer.

| <Coating liquid 5 for primer layer> | |
|---|---|
| Polyvinyl alcohol resin (KM-11, manufactured by The Nippon Synthetic Chemical Industry Co., Ltd.) | 6 parts |
| Water | 47 parts |
| Isopropyl alcohol | 47 parts |

Example 6

A thermal transfer sheet of Example 6 was prepared in the same manner as in Example 1, except that a coating liquid 6 having the following composition for a primer layer was used instead of the coating liquid 1 for a primer layer to form a primer layer.

| <Coating liquid 6 for primer layer> | |
|---|---|
| Polyvinyl pyrrolidone resin (K-15, manufactured by ISP) | 6 parts |
| Water | 47 parts |
| Isopropyl alcohol | 47 parts |

Example 7

A thermal transfer sheet of Example 7 was prepared in the same manner as in Example 1, except that a coating liquid 7 having the following composition for a primer layer was used instead of the coating liquid 1 for a primer layer to form a primer layer.

| <Coating liquid 7 for primer layer> | |
|---|---|
| Polyvinyl pyrrolidone resin (K-15, manufactured by ISP) | 6 parts |
| Sulfonated polyaniline (manufactured by Nitto Chemical Industry Co., Ltd.) | 0.6 part |
| Water | 46.7 parts |
| Isopropyl alcohol | 46.7 parts |

Comparative Example 1

A thermal transfer sheet of Comparative Example 1 was prepared in the same manner as in Example 1, except that a coating liquid 8 having the following composition for a primer layer was used instead o the coating liquid 1 for a primer layer to form a primer layer.

| <Coating liquid 8 for primer layer> | |
|---|---|
| Polyester resin (WR-961, manufactured by The Nippon Synthetic Chemical Industry Co., Ltd.) | 10 parts |
| Water | 45 parts |
| Isopropyl alcohol | 45 parts |

Comparative Example 2

A thermal transfer sheet of Comparative Example 2 was prepared in the same manner as in Example 1, except that a coating liquid 9 having the following composition for a primer layer was used instead of the coating liquid 1 for a primer layer to form a primer layer.

| <Coating liquid 9 for primer layer> | |
|---|---|
| Polyester resin (KZA 3534, manufactured by Unitika Ltd.) | 10 parts |
| Water | 65 parts |
| Isopropyl alcohol | 25 parts |

Comparative Example 3

A thermal transfer sheet of Comparative Example 3 was prepared in the same manner as in Example 1, except that a coating liquid 10 having the following composition for a primer layer was used instead of the coating liquid 1 for a primer layer to form a primer layer.

| <Coating liquid 10 for primer layer> | |
|---|---|
| Polyester resin (Vylon 700, manufactured by Toyobo Co., Ltd.) | 10 parts |
| Methyl ethyl ketone | 45 parts |
| Toluene | 45 parts |

The thermal transfer sheets of Examples and Comparative Examples thus prepared were evaluated for suitability for printing by the following methods.

Printing-Derived Cockling

A digital photoprinter Megapixel II manufactured by ALTECH CO., LTD. was provided. Check print patterns of a blotted part (gradation value 255/255: maximum density) and a white part (gradation value 0/255) were printed by means of this printer by using a combination of the thermal transfer sheets prepared in Examples and Comparative Examples with a genuine photographic paper (postcard size) for Megapixel II. Prints thus obtained were inspected for printing-derived cockling.

The results were evaluated according to the following criteria:

○: No printing-derived cockling observed in the print.

X: Printing-derived cockling observed in the print.

Transferred Image

Print patterns of a blotted image (gradation value 255/255: maximum density) were printed on the whole surface of the photographic paper under the same printing conditions as used in the evaluation of density. The prints were visually inspected for a failure to print such as uneven transfer and dropouts.

The results were evaluated according to the following criteria.

○: Any failure to print such as uneven transfer and dropouts not observed.

X: Any failure to print such as uneven transfer and dropouts observed.

The results of evaluation for Examples and Comparative Examples are shown in Table 1 below.

TABLE 1

| Ex. No. | G'a/G'b | 140° C. G'b [Pa] | 140° C. G"b [Pa] | 140° C. tan δ | Tg [° C.] | Printing-derived cockling | Transferred image |
|---|---|---|---|---|---|---|---|
| 1 | 50 | $2 \times 10^4$ | $5 \times 10^4$ | 2.5 | 75 | ○ | ○ |
| 2 | 67 | $3 \times 10^4$ | $6 \times 10^4$ | 2 | 77 | ○ | ○ |
| 3 | 35 | $2 \times 10^5$ | $2 \times 10^5$ | 1 | 73 | ○ | ○ |
| 4 | 13 | $3 \times 10^5$ | $3 \times 10^5$ | 1 | 68 | ○ | ○ |
| 5 | 5 | $1 \times 10^6$ | $2 \times 10^6$ | 0.2 | 73 | ○ | ○ |
| 6 | 10 | $1 \times 10^7$ | $1 \times 10^7$ | 1 | 135 | ○ | ○ |
| 7 | 15 | $8 \times 10^6$ | $9 \times 10^6$ | 1.1 | 135 | ○ | ○ |

TABLE 2

| Comp. Ex. No. | G'a/G'b | 140° C. G'b [Pa] | 140° C. G"b [Pa] | 140° C. tan δ | Tg [° C.] | Printing-derived cockling | Transferred image |
|---|---|---|---|---|---|---|---|
| 1 | >100* | $<10^3$* | $<10^3$* | >3* | 45 | X | X |
| 2 | $4.3 \times 10^4$ | $6 \times 10^3$ | $2 \times 10^4$ | 3.3 | 93 | X | ○ |
| 3 | $1.4 \times 10^5$ | $5 \times 10^3$ | $3 \times 10^4$ | 6 | 99 | X | X |

Regarding numerical values marked with *, due to the softening of the primer layer, measured values were scattered and stable values could not be obtained. In particular, for Comparative Example 1, upon a temperature change from 80° C. to 140° C., the viscoelasticity of the primer resin is rapidly lowered, that is, the storage modulus G'b at 140° C. is very small, and the value of G'a/G'b is considerably larger than 100.

For Comparative Examples 2 and 3, as soon as the polymer constituting the primer layer begins to soften due to a temperature rise, the storage modulus G' is lowered (although the level of lowering is not smaller than that in Comparative Example 1) and the value of G'a/G'b is increased.

As described above, the present invention provides a thermal transfer sheet comprising: a substrate sheet; a colorant layer provided on one side of the substrate sheet; and a heat-resistant slip layer provided on the other side of the substrate sheet through a primer layer. The primer layer comprises a binder resin satisfying a G'a/G'b ratio value of not more than 100 wherein G'a represents the storage modulus of the binder resin at 80° C., Pa; and G'b represents the storage modulus of the binder resin at 140° C., Pa. Preferably, both the storage modulus G'b (Pa) of the binder resin and the loss modulus G"b (Pa) of the binder resin each as measured at 140° C. are not less than $10^3$ Pa, and the binder resin has a tan δ value of not more than 3 at 140° C.

Regarding the binder resin satisfying the above relation expression of the modulus of elasticity, in the case of printing of an image in which a white image (a white part) and a black image (a black part) are present together, milder heat conditions are applied at the time of printing of the white part. In this case, the viscoelasticity of the primer component is high, and the storage modulus corresponds to G'a at 80° C. On the other hand, at the time of printing of the black part, since heat is applied, the viscoelasticity of the primer component is low and the storage modulus corresponds to G'b at 140° C. When the requirement G'a/G'b ratio of not more than 100 is satisfied, there is no fear of causing printing-derived cockling or fusing to a thermal head even upon printing of an image, in which a white part and a black part are present together, and, at the same time, a reduction in thickness of the substrate sheet and a high level of suitability for high speed printing can be realized.

The invention claimed is:

1. A thermal transfer sheet comprising: a substrate sheet; a colorant layer provided on one side of the substrate sheet; and a heat-resistant slip layer provided on the other side of the substrate sheet through a primer layer, said primer layer comprising a binder resin satisfying a G'a/G'b ratio value of not more than 100 wherein G'a represents the storage modulus of the binder resin at 80° C., Pa; and G'b represents the storage modulus of the binder resin at 140° C., Pa.

2. The thermal transfer sheet according to claim 1, wherein both the storage modulus G'b (Pa) of the binder resin and the loss modulus G"b (Pa) of the binder resin each as measured at 140° C. are not less than $10^3$ Pa.

3. The thermal transfer sheet according to claim 1, wherein said binder resin has a tan δ value of not more than 3 at 140° C.

4. The thermal transfer sheet according to claim 1, wherein said binder resin has a glass transition temperature Tg of 60° C. or above.

5. The thermal transfer sheet according to claim 1, wherein said primer layer contains an antistatic agent.

* * * * *